United States Patent [19]

Pisano

[11] 4,040,707

[45] Aug. 9, 1977

[54] CATHODE RAY TUBE BASE

[75] Inventor: John J. Pisano, Auburn, N.Y.

[73] Assignee: GTE Sylvania Incorporated, Stamford, Conn.

[21] Appl. No.: 702,094

[22] Filed: July 2, 1976

[51] Int. Cl.[2] ..... H01R 13/46

[52] U.S. Cl. ..... 339/111; 313/318; 339/143 T; 339/193 R

[58] Field of Search ..... 313/318; 339/111, 143 R, 339/143 T, 145 T, 192 T, 193, 194

[56] References Cited

U.S. PATENT DOCUMENTS

| | | | |
|---|---|---|---|
| 1,850,559 | 3/1932 | Marshall | 339/194 R |
| 2,659,061 | 11/1953 | Mirabella | 339/192 T |
| 3,867,671 | 2/1975 | Johnson | 339/111 |
| 3,958,854 | 5/1976 | Arrington | 339/111 |
| 3,979,157 | 9/1976 | DiMattio | 339/318 |

*Primary Examiner*—Roy Lake
*Assistant Examiner*—Mark S. Bicks
*Attorney, Agent, or Firm*—Norman J. O'Malley; William H. McNeill; Robert T. Orner

[57] ABSTRACT

A base for a cathode ray tube includes at least one tube pin isolating means formed within the rim of the base to provide arc prevention between adjacent tube pins which can have up to a 12 KV potential difference therebetween. The isolating means comprises a cutout portion in the rim and an electrically insulating plug to fit therein.

2 Claims, 2 Drawing Figures

CATHODE RAY TUBE BASE

BACKGROUND OF THE INVENTION

This invention relates to tube bases and more particularly to tube bases for cathode ray tubes which employ high voltage differentials between various tube pins.

Current and projected types of cathode ray tubes, particularly those employed in color television, have a small diameter neck containing the electron gun or guns. The necessary operating voltage for the various elements of these guns (heaters, cathodes, grids, focusing electrodes, etc.) are supplied via tube pins which are sealed into the end of the tube. As more efficient guns have developed, the neck diameter of these tubes has gotten smaller, thus dictating that the tube pins, which are annularly arrayed thereabout, keep getting closer together.

Prior art tubes have always had large voltage differentials, sometimes on the order of 5 KV to 8 KV. These high voltage connections have usually had some form of arc protection incorporated into the female socket, see, for example, U.S. Pat. Nos. 3,466,491 and 3,466,492. Such protection, however, has proven incapable of providing adequate protection for the newer tube types.

Another method previously employed, in conjunction with a base, was for an operator to individually dispense a fluid silicone about a high voltage lead, e.g., the focus lead. This process was troublesome because it took a long time for the silicone to cure. Further, dispensing the silicone by hand could cause bubbles or air pockets to form therein thus contributing to arcing problems. And, of course, an operator was required, thus adding an undesired cost to the tube.

OBJECTS AND SUMMARY OF THE INVENTION

Accordingly, it is an object of the invention to enhance voltage protection in cathode ray tubes.

It is another object of the invention to prevent or alleviate inter-pin arcing in cathode ray tubes.

Yet another object of the invention is the provision of arcing protection in a tube base.

Yet another object of the invention is to obviate the disadvantages of the prior art.

These objects are accomplished in one aspect of the invention by a tube base for a cathode ray tube which includes at least one tube pin isolating means formed within the rim of the base.

DESCRIPTION OF THE PREFERRED EMBODIMENTS

For a better understanding of the present invention, together with other and further objects, advantages and capabilities thereof, reference is made to the following drawings and appended claims taken in conjunction with the above-described drawings.

Figure 1:
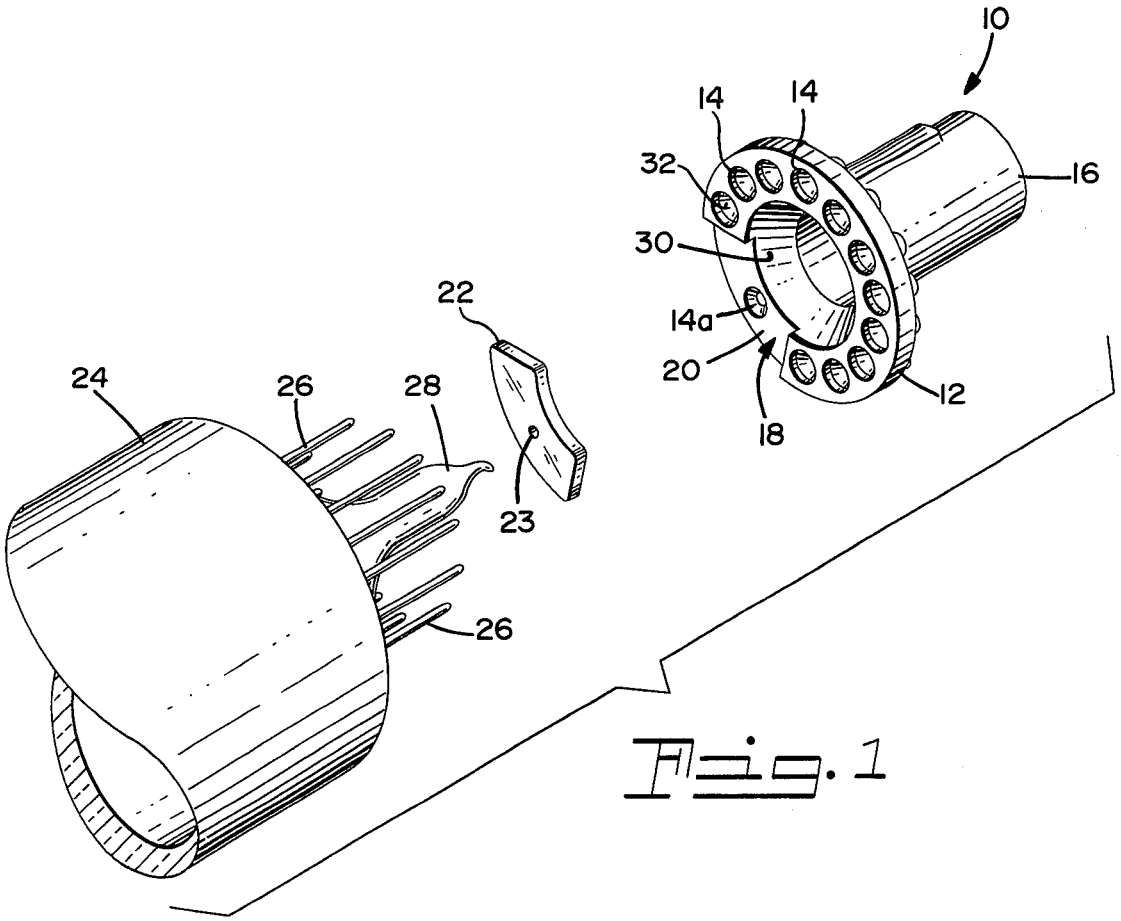
FIG. 1 is a perspective, exploded view of a tube base and cathode ray tube embodying the invention.

Referring now to the drawings with greater particularity, there is shown in FIG. 1, a base 10 for a cathode ray tube which comprises a substantially flat circular rim 12. A plurality of tube pin receiving apertures 14 extend through the rim 12 and are annularly arrayed and spaced inwardly from the outer circumference of rim 12. A hollow, substantially centrally located crown 16 is positioned on rim 12 and projects therefrom. At least one tube pin isolating means 18 is associated with at least one of the tube pin receiving apertures; e.g., 14*a*.

Figure 2:
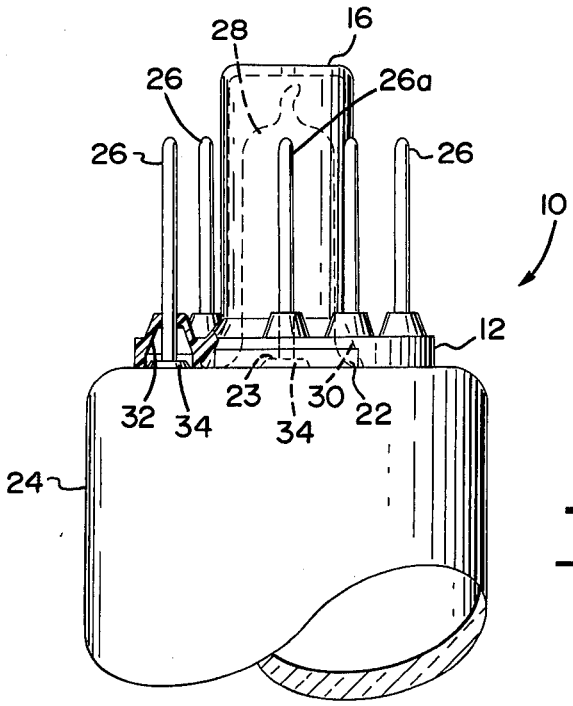
FIG. 2 is an elevational view, partially in section, of a tube base mounted on a cathode ray tube neck.

In the illustrated embodiment shown in FIGS. 1 and 2 the tube pin isolating means 18 includes a cut-out portion 20 formed within rim 12. The cut-out portion 20 extends beyond the aperture 14*a* and is formed to receive an electrically insulating plug 22 of a suitable material, such as silicone rubber. The plug 22 is centrally apertured as at 23 to receive a tube pin.

The depth of cut-out portion 20 is less than the thickness of rim 12 and should correspond to the thickness of plug 22 which preferably is of the order of 0.040 to 0.050 inch.

FIG. 2 shows base 10 in position of the neck 24 of a cathode ray tube. The tube pins 26 project through the apertures 14 in base 10 and at least one of the pins, 26*a*, can be a high voltage lead projecting through aperture 14*a*. Pin 26*a* is thus isolated from the remaining leads by isolating means 18 in the form of cut-out portion 20 and plug 22. The isolation extends primarily at the base-tube interface where arcing is most likely to occur.

The exhaust tubulation 28 projects into crown 16, which has its receiving end tapered, as at 30 to ease insertion. Likewise, the leading edges of apertures 14 and 14*a* are also tapered, as at 32, to ease insertion of the pins 26 and 26*a*.

The widest part of the taper 32 is sufficiently wide to encompass the glass nubbin 34 which surrounds each tube pin 26 and 26*a*. Also, the aperture 23 in plug 22 is of sufficient diameter to just encompass the nubbin 34.

In the illustrations it will be seen that the preferred shape for cut-out 20 and plug 22 is that of a segmented washer; however, other shapes might be employed.

It is also preferable that plug 22 be manufactured with an adhesive on both sides, this adhesive being covered with a release liner until insertion of the plug is desired.

Further, after the plug 22 is in position it is also desirable to cement the base to the tube neck by the use of an electrically insulating cement.

The use of this new and novel base greatly alleviates the problem of inter-pin arcing amoung tubes whose pins can have up to a 12KV potential difference therebetween.

While there has been shown and described what are at present considered the preferred embodiments of the invention, it will be obvious to those skilled in the art that various changes and modifications may be made therein without departing from the scope of the invention as defined by the appended claims.

What is claimed is:

1. In combination with a cathode ray tube, a base therefor, said cathode ray tube having a cylindrical terminal portion closed by a substantially planar wall provided with a plurality of annularly spaced, projecting tube pins each surrounded by a raised nubbin with a diameter larger than said pins where said pins exit from said wall, said base comprising a flat, circular rim having a diameter substantially equal to that of said cylindrical terminal portion; a plurality of tube pin receiving apertures extending through said rim for engaging said tube pins, said apertures being spaced inwardly from the outer circumference of said rim; and at least one tube pin isolating means formed within said flat circular rim, said tube pin isolating means including a cut-out portion having a depth less than the thickness of said rim and extending over a circumferential arc of less than 180° and an electrically insulating plug formed to fit said cut-out portion, said plug containing at least one aperture for receiving one of said tube pins, said one aperture having a diameter at least as large as the diameter of said nubbin.

2. The base of claim 1 wherein said plug is formed from silicone rubber.

* * * * *